United States Patent [19]

Nanjo et al.

[11] 4,201,171

[45] May 6, 1980

[54] IGNITION SYSTEM FOR A MULTICYLINDER ENGINE

[75] Inventors: Hirotoshi Nanjo; Kimihiro Boyama, both of Susono, Japan

[73] Assignee: Kokusan Denki Co., Ltd., Numazu, Japan

[21] Appl. No.: 902,292

[22] Filed: May 3, 1978

[30] Foreign Application Priority Data

May 4, 1977 [JP] Japan ..... 52-51494

[51] Int. Cl.[2] ..... F02P 1/08

[52] U.S. Cl. ..... 123/148 AC; 123/148 E; 315/209 T; 315/209 SC; 315/218

[58] Field of Search ..... 123/148 E, 148 AC, 148 DS, 123/148 ND, 149 R, 149 A; 310/70 A; 315/209 T, 209 SC, 218

[56] References Cited

U.S. PATENT DOCUMENTS

| | | | |
|---|---|---|---|
| 3,612,023 | 10/1971 | Sohner et al. | 123/149 A |
| 3,824,976 | 7/1974 | Katsumata et al. | 123/149 R |
| 3,878,824 | 4/1975 | Haubner et al. | 123/148 E |
| 4,016,433 | 4/1977 | Brooks | 123/148 E |
| 4,099,509 | 7/1978 | Hashimoto | 123/148 AC |
| 4,119,076 | 10/1978 | Sato | 123/148 E |

FOREIGN PATENT DOCUMENTS

| | | | |
|---|---|---|---|
| 1442787 | 7/1976 | United Kingdom | 310/70 A |

*Primary Examiner*—Charles J. Myhre
*Assistant Examiner*—Andrew M. Dolinar
*Attorney, Agent, or Firm*—Pearne, Gordon, Sessions, McCoy & Granger

[57] ABSTRACT

An ignition system for a multicylinder engine comprising a magneto having an igniting exciter coil to induce an AC voltage in synchronism with rotation of the engine; ignition coils having secondary coil portions respectively connected to ignition plugs for cylinders of the engine, to supply a high voltage to the respective ignition plugs; and a primary current controlling semiconductor switch connected to the igniting exciter coil in parallel therewith to be turned on in advance of respective igniting positions of the cylinders so that a current flows through the semiconductor switch. The ignition system further comprises a signal generator driven by the engine and having signal coils to generate timing signals at the respective igniting positions of the cylinders; and primary current conducting semiconductor switches provided between the respective primary coil portions of the ignition coils and the igniting exciter coil to be turned on by the respective timing signals from the signal generator to abruptly pass the primary current through the respective primary coil portions of the ignition coils whereby a high voltage is established across the secondary coil portions of the ignition coils to spark the ignition plugs.

8 Claims, 3 Drawing Figures

IGNITION SYSTEM FOR A MULTICYLINDER ENGINE

BACKGROUND OF THE INVENTION

An ignition system for a multiplecylinder engine which uses a battery as an ignition power supply is required to include a distributor which distributes a primary current to respective primary coil portions of ignition coils. Such an ignition system, however, has a disadvantage that the distributor tends to break down due to leakage of water into the distributor or other causes.

In order to eliminate such a disadvantage, there has been employed such as ignition system for a multicylinder engine that a magneto is used as an igniting power supply. In the prior art, this ignition system comprises a combination of ignition circuits provided individually for the respective cylinders of the engine. Therefore, the whole ignition system is large-sized and very complicated, which makes the ignition system expensive.

SUMMARY OF THE INVENTION

Accordingly, it is a principal object of the invention to provide an ignition system for a multicylinder engine which does not employ a distributor which is easy to break down, and which requires less maintenance.

It is another object of the invention to provide an ignition system for a multicylinder engine which is small-sized, simple in its construction and therefore inexpensive.

It is further object of the invention to provide an ignition system wherein a spark performance of the ignition system is not lowered.

In accordance with the invention, there is provided an ignition system for multicylinder engine comprising a magneto having an exciter coil to induce an AC voltage in synchronism with rotation of an engine; ignition coils having primary coil portions connected to the magneto and secondary coil portions connected to ignition plugs for cylinders of the engine, respectively, to supply a high voltage to the plugs; a primary current controlling semiconductor switch connected to the magneto in parallel therewith to be turned on in advance of the respective igniting positions of the cylinders so that a current flows through the primary current controlling semiconductor switch; a signal generator driven by the engine and having signal coils to generate timing signals at the respective igniting positions of the cylinders; and primary current conducting semiconductor switches provided between the respective primary coil portions of the ignition coils and the magneto and adapted to be turned on by the respective timing signals from the signal generator to abruptly pass the primary current through the respective primary coil portions of the ignition coils whereby a high voltage is established across the secondary coil portions of the ignition coils to spark the corresponding ignition plugs.

BRIEF DESCRIPTION OF THE DRAWINGS

The above and other objects and features of the invention will be understood from the description of the embodiments taken along with reference to the accompanying drawings in which.

DETAILED DESCRIPTION OF THE EMBODIMENTS

Figure 1:
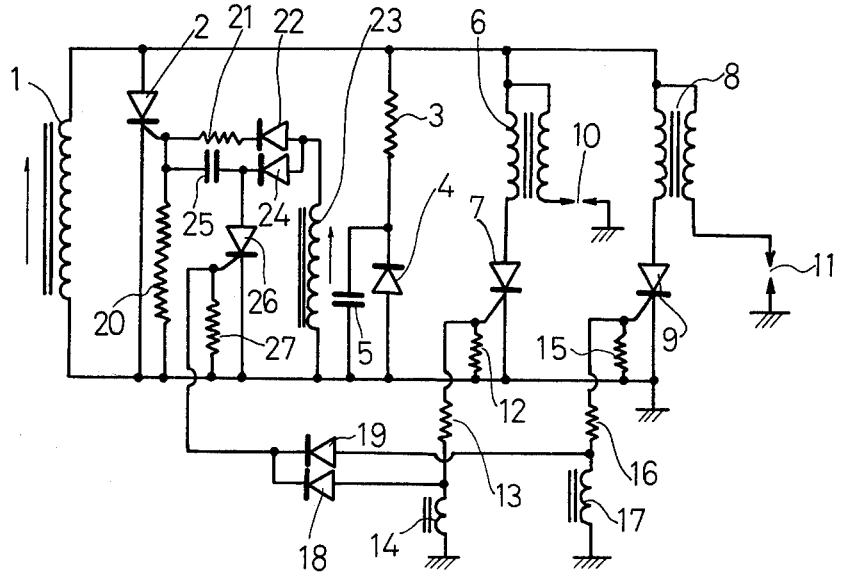
FIG. 1 is a schematic diagram of one embodiment of an ignition system for a multicylinder engine according to the invention.

Referring now to FIG. 1, there is shown an embodiment of an ignition system for a two-cylinder engine. This ignition system comprises a magneto 1 having an igniting exciter coil which induces an AC voltage in synchronism with rotation of the engine.

A primary current controlling semiconductor switch which is in the form of a gate turn-off thyristor 2 (hereinafter referred to as G.T.O.) has an anode and a cathode connected to both ends of an exciter coil of the magneto 1. The cathode of the G.T.O. 2 is grounded. A series connection of a resistor 3 and a diode 4, the cathode of which is connected to the resistor 3, is connected to the magneto 1 in parallel with the G.T.O. 2. A capacitor 5 is connected across the anode and cathode of the diode 4. This series connection serves to conduct a current therethrough, which current is produced by a voltage across the exciter coil of the magneto in a reverse direction to that of an arrow in FIG. 1.

A first ignition coil 6 has a primary coil portion, one end of which is connected to the point of connection between the exciter coil of the magneto 1 and the anode of the G.T.O. 2 and the other end of which is connected to the anode of a primary coil conducting semiconductor switch such as a thyristor 7, while the cathode of the thyristor 7 is connected to the point of connection between the exciter coil of the magneto 1 and the cathode of the G.T.O. 2. A second ignition coil 8 has a primary coil portion, one end of which is similarly connected to the point of connection between the exciter coil of the magneto 1 and the anode of the G.T.O. 2 and the other end of which is similarly connected to the anode of a primary coil conducting semiconductor switch such as a thyristor 9, while the cathode of the thyristor 9 is connected to the point of connection between the exciter coil of the magneto 1 and the cathode of the G.T.O. 2. Thus, it will be noted that the respective series connections of the ignition coils 6 and 8 and the thyristors 7 and 9 are connected to the exciter coil of the magneto 1 in parallel with the G.T.O. 2 and with each other. The ignition coils 6 and 8 have respective secondary coil portions which are connected in series with ignition plugs 10 and 11 in two cylinders of the engine.

There is provided a signal generator including two signal coils 14 and 17 for the respective cylinders of the engine, which is driven by the engine to generate timing signals at the respective igniting positions of the cylinders. The signal coils at one end are grounded and at the other end connected through resistors 13 and 16 to the gates of the thyristors 7 and 9, respectively, which gates are also connected through resistors 12 and 15 to the respective cathodes of the thyristors 7 and 9. The signal coils 14 and 17 at the one end are also connected to the anodes of diodes 18 and 19, respectively, the cathodes of which are connected to each other so as to form an OR gate.

There is also provided control means for controlling the gate of the G.T.O. 2, which comprises a coil 23 of a pulser. The pulser at one end is grounded and at the other end connected to the anodes of diodes 22 and 24, the cathodes of which are connected through a resistor 21 and a capacitor 25 to the gate of the G.T.O. 2 respectively. A resistor 20 is also connected across the gate and cathode of the G.T.O. 2.

An auxiliary thyristor 26 has the anode connected between the point of connection between the diode 24 and the capacitor 25, the cathode of the auxiliary thyristor 26 being grounded and the gate of the thyristor 26 being connected through a resistor 27 to the cathode thereof and also connected to the output of the OR gate or the cathodes of the diodes 18 and 19.

Figure 2:
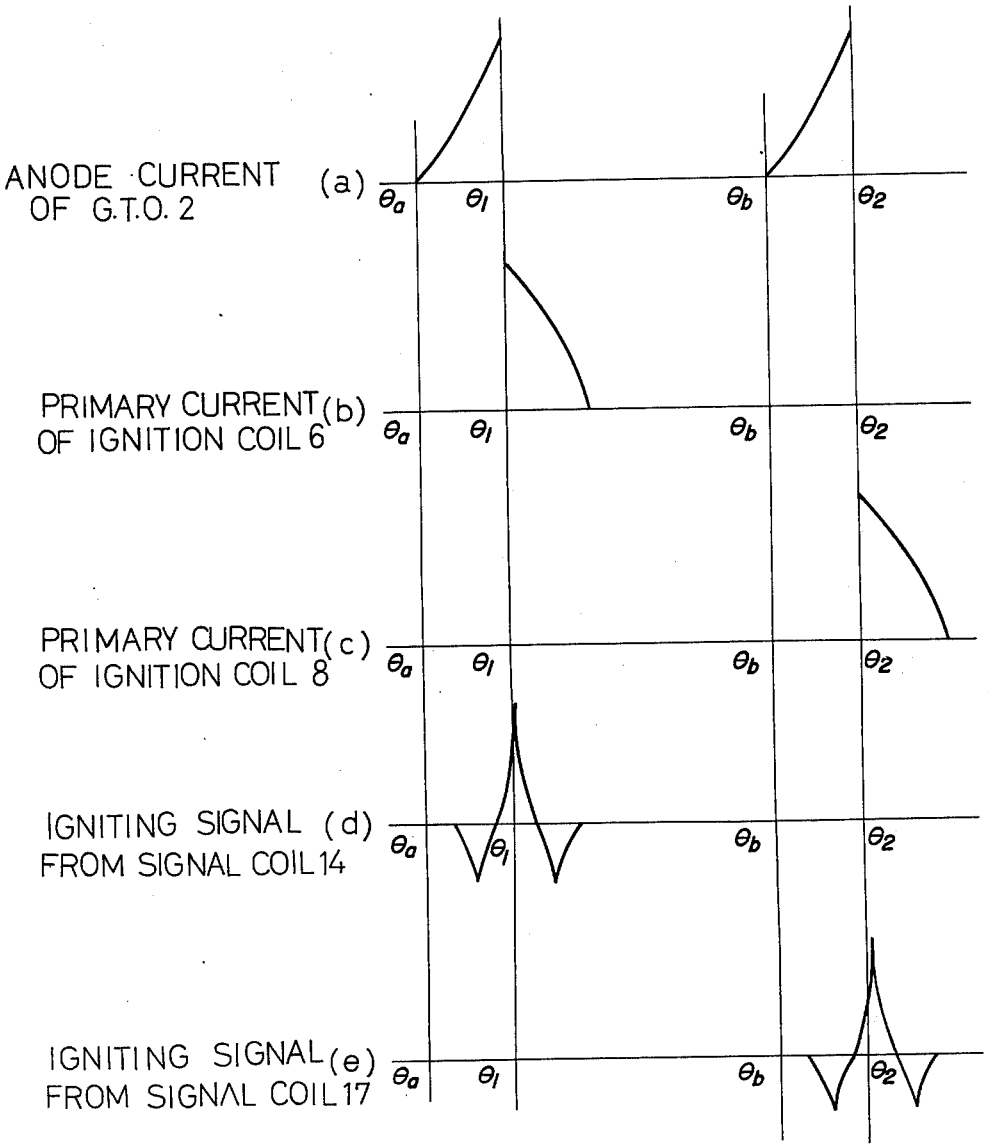
FIGS. 2*a* through 2*e* illustrate the operation of the portions of the ignition system of FIG. 1.

In operation, as the exciter coil 1 begins to induce a forward voltage in a direction of a solid arrow in FIG. 1 from the point of $\theta_a$ in FIG. 2, the pulser coil 23 concurrently induces a forward voltage in a direction of an arrow in FIG. 1, which causes a firing signal to be applied through the diode 22 and the resistor 21 to the gate of the G.T.O. 2. Accordingly, the G.T.O. 2 is turned on, and as a result an anode current flows through the G.T.O. 2 from the point of $\theta_a$ as shown in FIG. 2*a*. At that time, the capacitor 25 is charged through the diode 24 so that the cathode of the diode 24 is at a positive potential while the gate of the G.T.O. 2 is at a negative potential. At the igniting position $\theta_1$ of the first cylinder, the signal coil 14 for the first cylinder generates an igniting signal as shown in FIG. 2*d*, which is applied through the resistor 13 to the gate of the thyristor 7. This causes the thyristor 7 to be turned on. At the same time, the igniting signal is also applied through the diode 18 to the gate of the thyristor 26. This causes the thyristor 26 to be turned on. Thus, the capacitor 25 is discharged through the anode and cathode of the thyristor 26 and then through the cathode and gate of the G.T.O. 2. As a result, the G.T.O. 2 is turned off, and therefore, the anode current of the G.T.O. 2 is abruptly interrupted as shown in FIG. 2*a*. Because of such an abrupt change in the current, the exciter coil of the magneto 1 induces a high voltage thereacross. Since the thyristor 7 is in the conductive condition at that time, a large primary current abruptly flows through the primary coil portion of the ignition coil 6 for the first cylinder. Thus, the ignition coil 6 generates a high voltage across the secondary coil portion thereof, by which the ignition plug 10 in the first cylinder is spark-discharged to ignite or explode the first cylinder. It should be noted that the igniting signal from the signal coil 14 is not applied to the gate of the thyristor 9 because the diode 19 blocks the signal from the signal coil 14.

At the igniting position $\theta_2$ of the second cylinder, the anode current of the G.T.O. 2 which flows from the point $\theta_b$ in advance of the point $\theta_2$, is abruptly interrupted as shown in FIG. 2*a*, when the auxiliary thyristor 26 is turned on by the firing signal from the signal coil 17 for the second cylinder. At that time, the thyristor 9 is in the conductive condition, and as a result a large primary current flows through the primary coil portion of the ignition coil 8 for the second cylinder as shown in FIG. 2*c*. Thus, the ignition coil 9 generates a high voltage across the secondary coil portion thereof, by which the ignition plug 11 is spark-discharged to explode the second cylinder.

Figure 3:
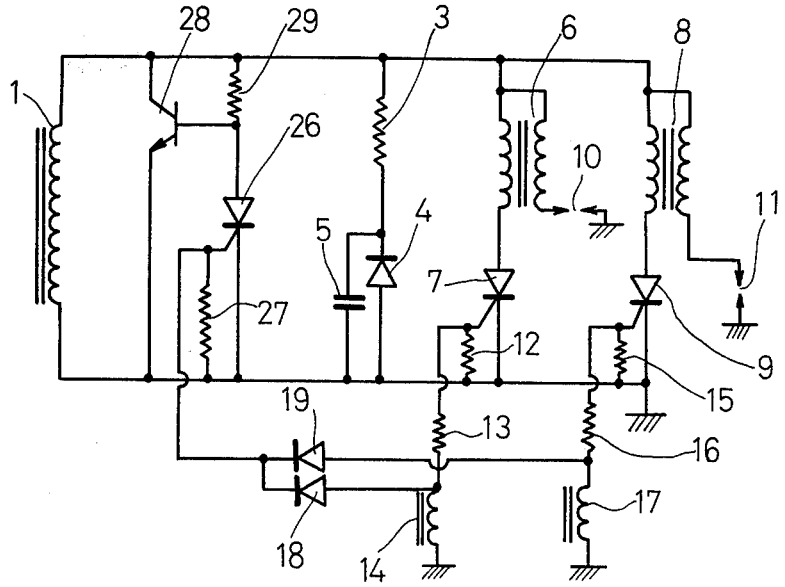
FIG. 3 is a schematic diagram of another embodiment of the invention.

FIG. 3 shows another embodiment of the ignition system for the multicylinder engine. This is substantially identical to the embodiment of FIG. 1, except that the primary current controlling semiconductor switch comprises a transistor 28 in place of the G.T.O. 2 of the aforementioned embodiment. The collector and emitter of the transistor 28 are connected to both ends of the exciter coil of the magneto 1 with the emitter being grounded, while the base of the transistor 28 is connected through a resistor 29 to the collector of the transistor 28 and also to the anode of the thyristor 26. Also, in this embodiment, the pulser 23, the diodes 22 and 24, the resistor 21 and the capacitor 24 of FIG. 1 are not required. The operation of the ignition system of FIG. 3 is also identical to that of FIG. 1, but the transistor 28 which is normally conductive, is turned off when the thyristor 26 is turned on by the signals from the signal coils 14 and 17 of the signal generator, so that the primary current flows through the primary coil portion of the ignition coil 6 or 8.

It will be understood that the invention can be applicable to an engine having three, four, six and more cylinders in a similar manner. In these cases, the number of the ignition coils, the ignition plugs, the primary current conducting semiconductor switches, the signal coils of the signal generator and the diodes to output the signals from the signal coils should be increased in correspondence to the number of the cylinders.

It will be noted that two ignition plugs may be connected to each of the secondary coil portions of the ignition coils 6 and 8 so that the ignition plugs are provided at both ends of the secondary coil portions in a symmetrical manner. In this case, the system can be applied to an engine having twice as many cylinders as ignition coils, but it should be noted that each of the two ignition plugs connected to each ignition coil should be provided in each of the two cylinders, one of which is at the ignition position while the other cylinder is at the end of the exhaust position. Thus, if another ignition plug is provided for each of the ignition coils 6 and 8 in the embodiments of FIGS. 1 and 3, it will be noted that the system may be applied to a four cycle and four cylinder engine.

Although some embodiments of the invention have been illustrated and described with reference to the accompanying drawings, it will be understood by those skilled in the art that various changes and modifications may be made without departing from the spirit and scope of the invention, which is intended to be defined only to the appended claims.

What is claimed is:

1. An ignition system for a multicylinder engine comprising a magneto having an igniting exciter coil to induce an AC voltage in synchronism with rotation of the engine;

ignition coils each having a primary coil portion and a secondary coil portion connected to an ignition plug for each cylinder of said engine to supply a high voltage across said ignition plug;

a primary current controlling semiconductor switch connected in parallel with said igniting exciter coil;

a control circuit to control said primary current controlling semiconductor switch so that the primary current controlling semiconductor switch is turned on in advance of each igniting position of the respective cylinders and is turned off when a timing signal is applied to the control circuit;

a signal generating means driven by said engine and having signal coils which generate the timing signals at said respective igniting positions of the cylinders;

primary current conducting semiconductor switches corresponding to said ignition coils and connected in series with the respective primary coil portions of the ignition coils, the respective series connections of the primary coil portions and the primary current conducting semiconductor switches being connected in parallel with said igniting exciter coil;

said signal coils being coupled to the respective primary current conducting semiconductor switches so that the respective primary current conducting semiconductor switches are turned on by the respective timing signals;

and said signal coils being further coupled to said control circuit to supply the timing signals thereto;

whereby said primary current controlling semiconductor switch is turned off at the same time as said primary current conducting semiconductor switches are turned on at the respective igniting positions of the cylinders and a high voltage is established across said secondary coil portions of said ignition coils to spark the corresponding ignition plugs.

2. An ignition system for a multicylinder engine as set forth in claim 1, wherein said primary current controlling semiconductor switch comprises a gate turn-off thyristor, and said control circuit comprises a pulser coil to supply a firing signal to a gate of said gate turn-off thyristor in advance of the respective igniting positions of said cylinders, a capacitor connected to be charged by said pulser coil, and an auxiliary thyristor connected to receive the respective timing signals from said signal generating means, said capacitor being discharged through said auxiliary thyristor and then a cathode and gate of said gate turn-off thyristor to turn off said gate turn-off thyristor.

3. An ignition system for a multicylinder engine as set forth in claim 2, and further comprising an OR gate provided between said signal coils of said signal generating means and a gate of said auxiliary thyristor.

4. An ignition system for a multicylinder engine as set forth in claim 3, wherein said OR gate comprises diodes each having an anode connected to a corresponding signal coil of said signal generating means and a cathode connected to the gate of said auxiliary thyristor.

5. An ignition sysbem for a multicylinder engine as set forth in claim 1, wherein said primary current controlling semiconductor switch comprises a transistor, said control circuit comprises means to supply a turn-on current from said igniting exciter coil to a base of the transistor in advance of the respective igniting positions of said cylinders, and an auxiliary thyristor connected to said transistor so that said transistor is turned off when said auxiliary thyristor is turned on, and said timing signals being applied to a gate of said auxiliary thyristor to turn on said auxiliary thyristor.

6. An ignition system for a multicylinder engine as set forth in claim 5, wherein said means to supply a turn-on current from said exciter coil comprises a resistor connected between a collector and a base of said transistor.

7. An ignition system for a multicylinder engine as set forth in claim 5, and further comprising an OR gate provided between said signal coils of said signal generating means and the gate of said auxiliary thyristor.

8. An ignition system for a multicylinder engine as set forth in claim 7, wherein said OR gate comprises diodes each having an anode connected to a corresponding signal coil of said signal generating means and a cathode connected to the gate of said auxiliary thyristor.

* * * * *